US008006710B2

(12) United States Patent
Käske

(10) Patent No.: US 8,006,710 B2
(45) Date of Patent: Aug. 30, 2011

(54) CLEANING DEVICE AND METHOD FOR CLEANING A WORKPIECE

(75) Inventor: Egon Käske, Aachen (DE)

(73) Assignee: Dürr Ecoclean GmbH (DE)

( * ) Notice: Subject to any disclaimer, the term of this patent is extended or adjusted under 35 U.S.C. 154(b) by 0 days.

(21) Appl. No.: 12/906,759

(22) Filed: Oct. 18, 2010

(65) Prior Publication Data

US 2011/0088726 A1 Apr. 21, 2011

Related U.S. Application Data

(63) Continuation of application No. PCT/EP2009/054226, filed on Apr. 8, 2009.

(30) Foreign Application Priority Data

Apr. 18, 2008 (DE) ..... 10 2008 019 456

(51) Int. Cl.
*B08B 3/00* (2006.01)
*B08B 3/12* (2006.01)
*B08B 6/00* (2006.01)

(52) U.S. Cl. ..... 134/172; 134/144; 134/147; 134/148; 134/155; 134/191

(58) Field of Classification Search ..... 134/172, 134/144, 147, 148, 155, 191
See application file for complete search history.

(56) References Cited

U.S. PATENT DOCUMENTS

| | | | |
|---|---|---|---|
| 5,679,383 | A | 10/1997 | Ryan et al. |
| 5,962,041 | A | 10/1999 | Ryan et al. |
| 6,019,291 | A | 2/2000 | Tankersley |
| 6,612,829 | B2 | 9/2003 | Rübhausen |
| 2002/0046760 | A1 | 4/2002 | Halbmaier |
| 2003/0102015 | A1 | 6/2003 | Halbmaier et al. |

FOREIGN PATENT DOCUMENTS

| | | |
|---|---|---|
| CA | 1249204 | 1/1998 |
| CA | 2236950 | 11/1998 |
| DE | 3333802 | 3/1984 |
| DE | 3702675 | 8/1988 |
| DE | 9422051 | 9/1997 |
| DE | 10129627 | 2/2003 |
| DE | 102004046802 | 4/2006 |
| DE | 69832432 | 8/2006 |
| EP | 1270175 | 1/2003 |
| EP | 1640077 | 3/2006 |
| GB | 2127326 | 4/1984 |
| WO | 9601343 | 1/1996 |

OTHER PUBLICATIONS

International Searching Authority, International Search Report issued for PCT/EP2009/054226, mailed on Jan. 22, 2010, 10 pages.
German Patent and Trademark Office, Search Report issued for DE 10 2008 019 456.5, dated Oct. 18, 2010, 4 pages.

*Primary Examiner* — Michael Barr
*Assistant Examiner* — Charles W Kling
(74) *Attorney, Agent, or Firm* — Hanley, Flight & Zimmerman, LLC.

(57) ABSTRACT

In order to produce a cleaning device which cleans in a particularly effective manner wherein the cleaning device comprises a cleaning chamber for accommodating a workpiece requiring cleaning and a fluid transfer device for transferring at least one fluid into the cleaning chamber and/or out of the cleaning chamber and wherein the fluid transfer device comprises at least one nozzle in the form of a slotted nozzle extending along a slot axis and said fluid is arranged to be fed into the cleaning chamber or fed out of the cleaning chamber by means of said fluid transfer device in a direction transverse to the slot axis, it is proposed that the cleaning device comprise a slotted nozzle moving device for moving at least a part of the slotted nozzle.

14 Claims, 6 Drawing Sheets

CLEANING DEVICE AND METHOD FOR CLEANING A WORKPIECE

RELATED APPLICATION

This application is a continuation application of PCT/EP2009/054226 filed Apr. 8, 2009, the entire specification of which is incorporated herein by reference.

FIELD OF DISCLOSURE

The present invention relates to a cleaning device comprising a cleaning chamber for accommodating a workpiece requiring cleaning and a fluid transfer device for transferring at least one fluid into the cleaning chamber and/or out of the cleaning chamber, wherein the fluid transfer device comprises at least one nozzle in the form of a slotted nozzle extending along a slot axis and wherein the at least one fluid is arranged to be fed into the cleaning chamber or fed out of the cleaning chamber by said slotted nozzle in a direction transverse to the slot axis.

BACKGROUND

A device for the cleaning of workpieces utilising a wet process which incorporates a long slotted nozzle for the production of a knife-like high pressure jet spray is known from DE 37 02 675 A1.

A flushing device for expelling a curtain-like jet of cleaning fluid is known from DE 33 33 802 A1.

SUMMARY OF THE INVENTION

Based on the foregoing, the object of the present invention is to produce a cleaning device with which a particularly good cleaning effect is attainable.

In accordance with the invention, this object is achieved in the case of a cleaning device incorporating the features indicated in the first part of claim 1 in that the cleaning device comprises a slotted nozzle moving device for moving at least a part of the slotted nozzle.

The cleaning device in accordance with the invention makes it possible for a fluid to be fed into the cleaning chamber or fed out of the cleaning chamber such that it is distributed along the slot axis of the slotted nozzle.

With the help of the slotted nozzle moving device, at least a part of the slotted nozzle can be moved in such a way that the direction in which the fluid is transferred through the slotted nozzle is changeable. The effective direction of the fluid can be adapted in this way so as to achieve optimal cleaning even of workpieces having a complex shape. In particular, the slotted nozzle moving device enables the direction in which the fluid is transferred to be adapted in such a way that sections of a workpiece such as e.g. recesses or undercut regions which are difficult to access can be exposed to the effect of the fluid. The formation of so-called "spraying shadows" can thus be prevented. Moreover, this results in very short cycle times for the cleaning of a workpiece due to the highly effective cleaning action of the cleaning device in accordance with the invention.

The slotted nozzle enables a very high throughput of liquid per unit of time to be obtained, whereby a particularly good cleaning effect is achieved.

Preferably, the fluid transfer device is arranged within the cleaning chamber, whereby direct transfer of a fluid into the cleaning chamber and/or out of the cleaning chamber is possible.

It is particularly preferred that the slotted nozzle be movable in such a manner that the mean direction in which the fluid is transferred through the slotted nozzle and the surface of the workpiece which is to be cleaned include therebetween an angle of at least approximately 30° to at most approximately 70°. A particularly good cleaning effect can thereby be obtained.

Preferably, a spacing between two opposite chamber walls of the cleaning chamber is equal to or slightly greater than an extent of the slotted nozzle in a direction parallel to the slot axis. The effective range of the slotted nozzle with respect to a given chamber volume can thereby be maximized.

Preferably, the ratio of the slot width to the slot length of the slotted nozzle amounts to between approximately 1:10 and approximately 1:500, and in particular, to between approximately 1:100 and approximately 1:200. Such slotted nozzles enable a high fluid transfer rate to be obtained.

One advantageous embodiment of the invention envisages that the fluid transfer device should comprise a fluid feed-in device for feeding at least one fluid into the cleaning chamber. This thus enables the cleaning device to have a flushing or blowing-off mode of operation.

In particular, a liquid fluid and/or a gaseous fluid can be fed into the cleaning chamber. It is preferred that pressure be applied to the fluid, for example, a pressure of at least approximately 1 bar and/or at most approximately 10 bar.

A particularly good cleaning effect is obtained if a liquid fluid and a gaseous fluid are arranged to be fed into the cleaning chamber successively in time.

For example, the liquid fluid is water which works as a cleaning fluid. For example, the gaseous fluid is air, and in particular, compressed air.

It is preferred that the fluid transfer device should comprise a fluid feed-out device for feeding at least one fluid out of the cleaning chamber. This makes it possible for a fluid that has been fed into the cleaning chamber and/or pollutants to be transported away from the cleaning chamber. Advantageously, the cleaning chamber can be evacuated in order to enable dirt particles to be transported away in a particularly effective manner.

In accord with a particularly advantageous embodiment of the invention, the fluid transfer device forms or comprises both a fluid feed-in device and a fluid feed-out device. This results in a particularly flexible cleaning process. In particular it is preferred that the process of feeding a fluid into the cleaning chamber and the process of feeding a fluid out of the cleaning chamber be effected by means of the same slotted nozzle.

Preferably, the slotted nozzle is pivotal or rotatable by means of the slotted nozzle moving device. The slotted nozzle thereby has a particularly large effective range. Preferably, the angle through which the slotted nozzle is pivotal amounts to at least approximately 90°, and in particular, to at least approximately 180°. Furthermore, it is expedient if the slotted nozzle is rotatable through at least approximately 360° or is freely rotatable.

In accord with one embodiment of the invention, the axis of rotation about which the slotted nozzle is pivotal or rotatable and the slot axis of the slotted nozzle are collinear. A particularly compact fluid transfer device can thus be produced.

In accord with a further advantageous embodiment, the rotational axis about which the slotted nozzle is pivotal or rotatable and the slot axis of the slotted nozzle are mutually displaced. This makes it possible to produce an effective fluidic connection between the slotted nozzle and a fluid supply source in a particularly simple manner.

Advantageously, the cleaning device comprises a slot-width adjusting device for adjusting the slot-width of the slotted nozzle. This enables the geometry of the slotted nozzle to be adapted to differing flows of fluid and/or differing densities of the fluid. For example, the slot-width is adjustable in dependence on the density of the fluid so that smaller slot-widths can be set for fluids of higher density, for liquids for example, whereas larger slot-widths can be set for fluids of lower density, for gases and in particular for compressed air for example.

Preferably, at least one slot delimiting element is movable in a direction transverse to the slot axis, this thereby resulting in a particularly simple process for adjusting the width of the slot. Furthermore, it is expedient if the spacing between at least two slot delimiting elements is adjustable. In particular, mutually opposite slot delimiting elements can be movable relative to one another.

In accord with a preferred embodiment of the invention, the slot-width adjusting device comprises at least one adjusting element which is movable along an adjustment axis. Such an adjusting element is, for example, effective directly or indirectly on at least one slot delimiting element and thus enables the slot-width to be adjusted in a particularly simple and reliable manner.

Preferably the adjustment axis, along which at least one adjusting element of the slot-width adjusting device is movable, is substantially parallel to the slot axis. This makes it possible for a longitudinal movement of the adjusting element to be transformed into a movement of a slot delimiting element in a direction transverse to the slot axis in a particularly simple and space saving manner.

In particular, the adjustment axis can be collinear with an axis of rotation of the slotted nozzle moving device. A particularly compact slot-width adjusting device can thereby be created.

It is particularly preferred that the adjusting element be pivotal or rotatable about the adjustment axis. This enables the slot-width of the slotted nozzle to be adjusted independently of any pivotal or rotational positioning of the slotted nozzle.

Furthermore, it is expedient for the adjusting element to be pivotal or rotatable independently of the linear movement of the adjusting element. This makes it possible to provide a fixed and stable driving device for the slot-width adjusting device.

It is particularly preferred that the slot-width adjusting device and the slotted nozzle moving device be operable independently of one another. The slot-width of the slotted nozzle is thereby adjustable independently of whether or how at least a part of the slotted nozzle is being moved by means of the slotted nozzle moving device.

The slot-width adjusting device and the slotted nozzle moving device are preferably operable at the same time, and in particular during the process of feeding at least one fluid into the cleaning chamber or feeding out said fluid from the cleaning chamber.

Furthermore, it is preferred that the cleaning chamber should have at least one chamber wall and that a direction in which the fluid is fed-in through the slotted nozzle be adjustable in such a manner that at least one section of at least one chamber wall of the cleaning chamber can be cleaned by means of the fluid being fed-in. For example, the at least one section of the at least one chamber wall can be rinsed off or blown off whereby one can dispense with a separate cleaning device.

In particular, the slotted nozzle is rotatable through at least 360° for the purposes of cleaning the cleaning chamber. This enables chamber walls that are arranged peripherally around the slot axis to be subjected to a thorough cleansing process. In particular, all the chamber walls of the cleaning device are cleansable by means of the fluid being fed in through the slotted nozzle.

In accord with a further development of the invention, the cleaning device comprises a fluid line system which is connected in fluid conveying manner to the fluid transfer device for the purposes of supplying or removing a fluid and which comprises a plurality of fluid lines for mutually differing fluids. For example, the fluid line system may comprise fluid lines for at least one liquid such as water and/or a cleaning agent for example, and for at least one gas such as compressed air for example and/or for a gas which has to be sucked out of the cleaning chamber. This enables the cleaning device to be operated in a particularly flexible manner.

Furthermore, it is expedient for the cleaning device to comprise a workpiece moving device for moving a workpiece that is accommodated in the cleaning chamber relative to the slotted nozzle. A workpiece is thus movable relative to the cleaning chamber and/or is movable together with the cleaning chamber by means of such a workpiece moving device.

For example, the workpiece moving device comprises a holding device for holding the workpiece in the cleaning chamber, said holding device preferably being in the form of rotary support which is also referred to as a gymwheel (in German: "Rhönrad"). Such a rotary support can be rotated at a higher rotational speed due to the effective way in which the movable slotted nozzle functions, this thereby resulting in a reduction of the cycle time. Due to the degree of movement of the slotted nozzle, the effect is achieved that a workpiece can be subjected continuously to a fluid and that traverses of the turntable do not lead to the formation of a spraying shadow on that surface of a workpiece which is to be cleaned.

Preferably the workpiece is pivotal or rotatable about a rotational axis so that it can be cleaned in a particularly effective manner. In particular, such a rotational axis is substantially parallel to the slot axis so that a workpiece can be cleaned in an even manner.

A further advantageous embodiment of the invention envisages that the slotted nozzle moving device and a workpiece moving device are coupled to one another in order to co-ordinate the movements of the slotted nozzle and the workpiece. In particular, it is preferred that the rotational and/or pivotal frequencies of the slotted nozzle moving device and the workpiece moving device be co-ordinated with one another so that an "intelligent" moveable nozzle system can be created. A particularly preferred embodiment of the invention envisages that the rotational or pivotal frequency of the slotted nozzle moving device be equal to an integral multiple of the rotational or pivotal frequency of the workpiece moving device.

In accord with a further advantageous embodiment of the invention, the cleaning chamber can be filled with a liquid bath into which at least a section of a workpiece requiring cleaning and/or a slotted nozzle opening of the slotted nozzle is arranged to be dipped. Impurities can be washed off or soaked off the workpiece by immersing the workpiece requiring cleaning in the liquid bath. A particularly low-spray fluid discharge is made possible due to the immersion of the slotted nozzle opening of the slotted nozzle. By simultaneously immersing at least one section of a workpiece requiring cleaning and the slotted nozzle opening of the slotted nozzle in the liquid bath, the workpiece requiring cleaning can be subjected to a fluid being delivered from the slotted nozzle and thereby cleaned, whereby a particularly efficient and noiseless operation of the cleaning device is made possible. A cleaning process of this type is also referred to as "injection flood washing".

Furthermore, the invention relates to a method for the cleaning of a workpiece, wherein a workpiece is arranged in a cleaning chamber and at least one fluid is fed into the cleaning chamber or fed out from the cleaning chamber by a fluid transfer device which comprises a nozzle in the form of a slotted nozzle which extends along a slot axis and wherein the direction of feed is transverse to the slot axis.

A further object of the invention is to provide a method for the cleaning of a workpiece with which a particularly effective cleaning action is attainable.

In accordance with the invention, this object is achieved in the case of a method for the cleaning of a workpiece of the type specified hereinabove in that at least a part of the slotted nozzle is moved relative to the cleaning chamber.

Particular embodiments and advantages of the method in accordance with the invention have already been described in connection with the particular embodiments and the advantages of the device in accordance with the invention.

The cleaning device in accordance with the invention is particularly suitable for carrying out the method for the cleaning of a workpiece in accordance with the invention.

An effective cleaning process having a very low blank value is obtained by means of a small number of inlets to and outlets from the cleaning chamber and by the flushing of the outlets. The blank value indicates the degree of contamination of the cleaning chamber with impurities which can remain in the cleaning chamber after a cleaning process and can have a negative affect upon a subsequent cleaning process.

Further features and advantages of the invention form the subject matter of the following description and the graphical illustration of preferred exemplary embodiments.

BRIEF DESCRIPTION OF THE DRAWINGS

Similar or functionally equivalent elements are designated by the same reference symbols in each of the Figures.

DETAILED DESCRIPTION OF THE DRAWINGS

Figure 1:
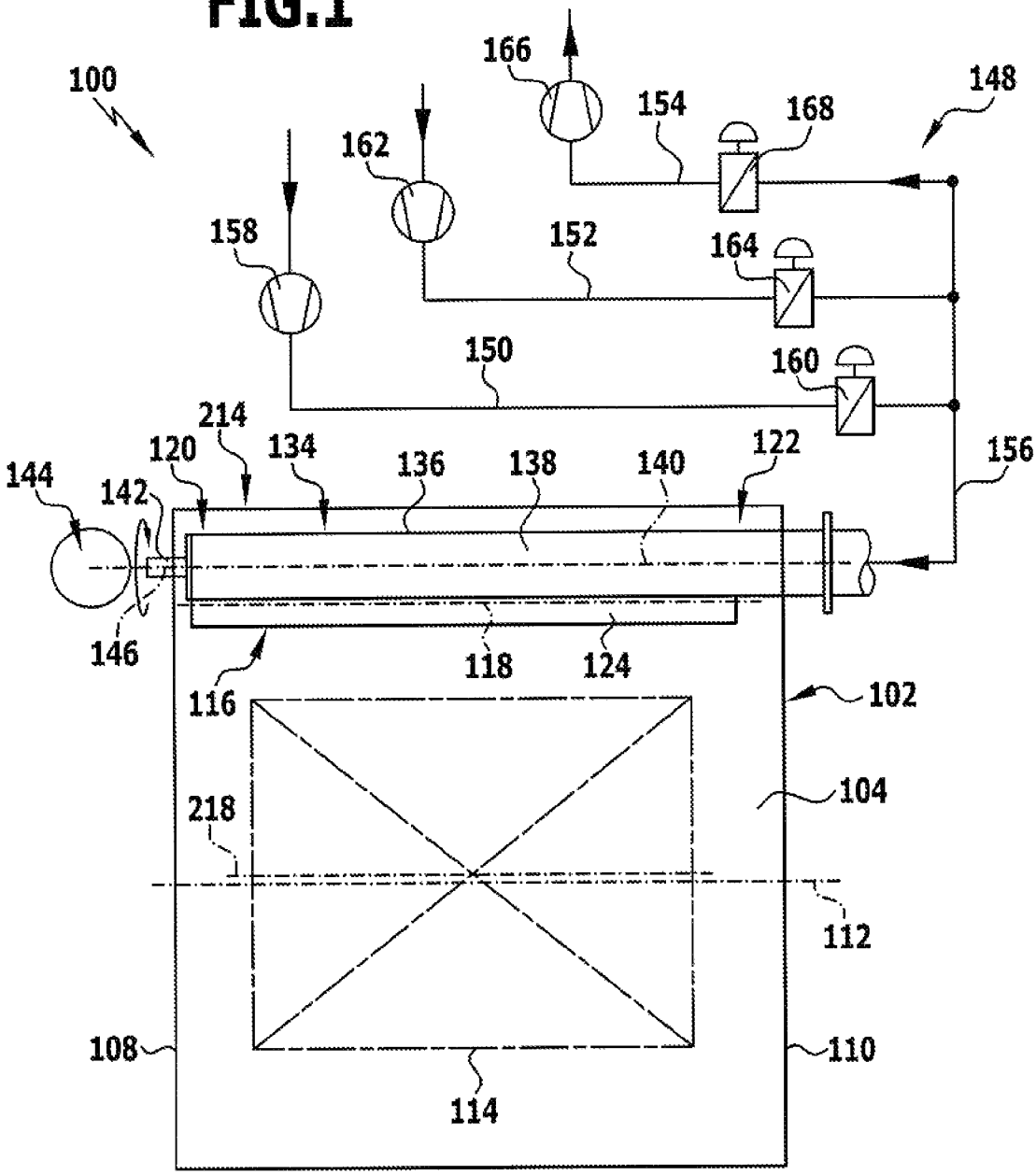
FIG. 1 shows a schematic front view of a first embodiment of a cleaning device comprising a slotted nozzle and a slotted nozzle moving device.

A cleaning device for the cleaning of a workpiece which bears the general reference 100 and is illustrated in FIG. 1 comprises a container 102 which bounds a cleaning chamber 104.

The container 102 is substantially in the form of a hollow cylinder and has a cylindrical outer chamber wall 106 which adjoins a first end wall 108 and a second end wall 110. The container 102 has a container axis 112 which corresponds to the cylinder axis of the chamber wall 106.

Figure 2:
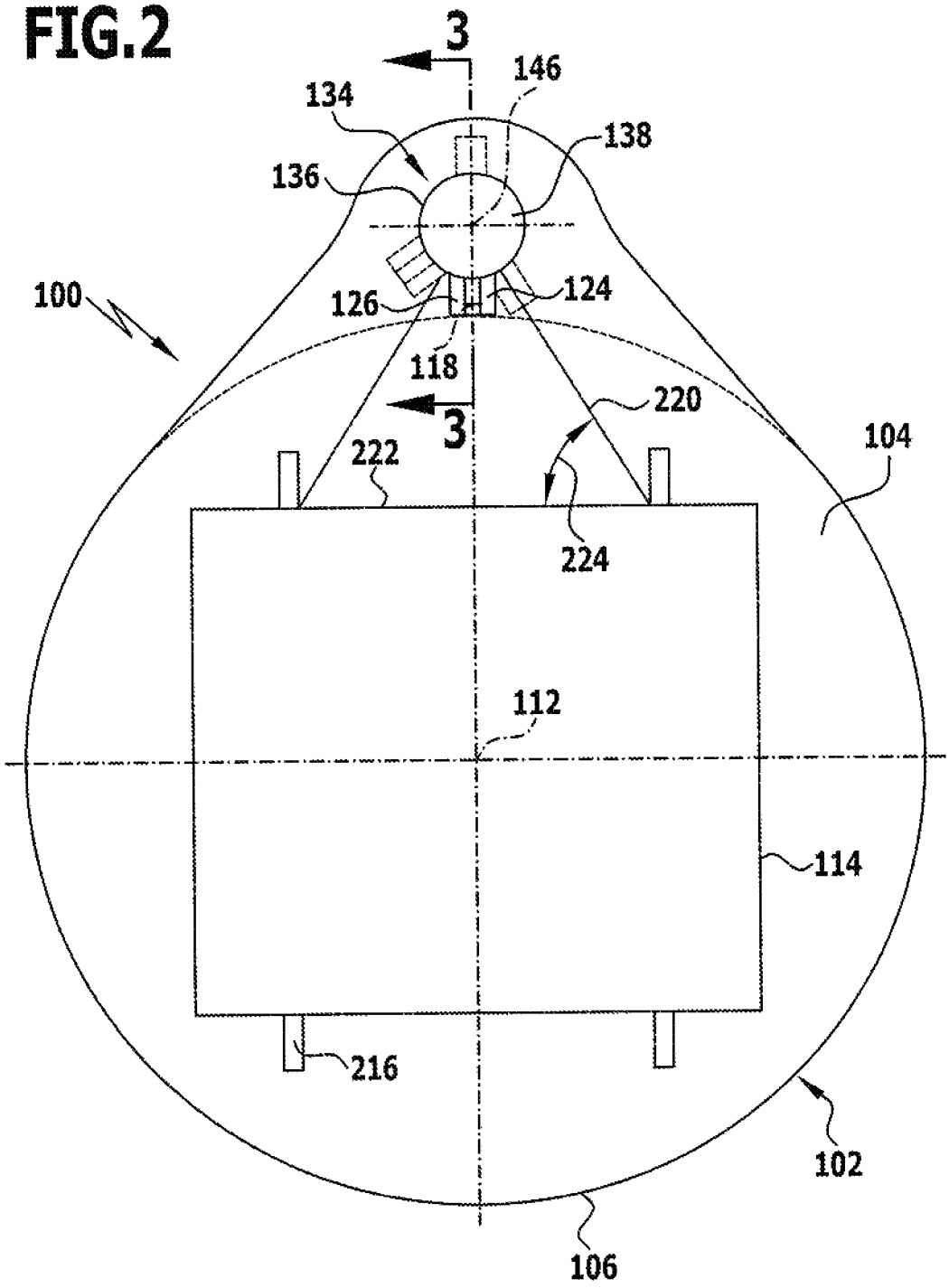
FIG. 2 a schematic side view of the cleaning device depicted in FIG. 1.

The container 102 serves to accommodate a washing load in the form of a workpiece 114 which requires cleaning and is schematically illustrated in FIGS. 1 and 2.

Furthermore, the cleaning device 100 comprises a slotted nozzle 116 which extends along a slotted nozzle axis 118. The slotted nozzle 116 is arranged in the upper region of the cleaning chamber 104 taken with reference to the direction of gravity. The slot axis 118 is preferably parallel to the container axis 112.

The slotted nozzle 116 extends along the slot axis 118 between a first end 120 of the slotted nozzle and a second end 122 of the slotted nozzle. The first end 120 of the slotted nozzle is arranged such that it neighbours the first end wall 108 of the cleaning chamber 104. The second end 122 of the slotted nozzle is arranged such that it neighbours the second end face 110 of the cleaning chamber 104.

The slotted nozzle 116 comprises a first slot delimiting element 124 and a second slot delimiting element 126. The slot delimiting elements 124, 126 delimit a slot having a length corresponding to the extent of the slot delimiting elements 124 and 126 in a direction parallel to the slot axis 118 whilst the width 128 of the slot corresponds to the spacing between the mutually opposite slot delimiting surfaces 130, 132.

Furthermore, the cleaning device 100 comprises a housing 134 having a substantially cylindrical outer housing wall 136. The housing wall 136 bounds a cylindrical fluid space 138 which is connected to the slotted nozzle 116 in fluid conveying manner.

The housing 134 has a housing axis 140 which extends substantially parallel to the slot axis 118.

Furthermore, the housing 134 has a drive section 142 which is connected to the housing wall 136 in mutually non-rotatable manner. The drive section 142 is rotatable about an axis of rotation 146 with the help of a slotted nozzle moving device 144. The axis of rotation 146 is collinear with the housing axis 140.

Furthermore, the cleaning device 100 comprises a fluid line system 148 having a plurality of fluid lines for fluids which differ from one another. For example, the fluid line system 148 comprises a first fluid line 150, a second fluid line 152 and a third fluid line 154. The fluid lines 150, 152 and 154 are connectable in fluid conveying manner to a common fluid line 156 which, for its part, is connected in fluid conveying manner to the fluid space 138.

A first pump 158 and a first valve 160 are associated with the first fluid line 150. A second pump 162 and a second valve 164 are associated with the second fluid line 152. A third pump 166 and a third valve 168 are associated with the third fluid line.

The first pump 158 and the second pump 162 serve to convey a fluid into the fluid space 138 and from there, through the slotted nozzle 116 into the cleaning chamber 104.

The third pump 166 serves to convey away a fluid accommodated in the cleaning chamber 104. The flow of fluid through the lines 150, 152, 154 can be controlled with the help of the respective valves 160, 164, 168.

A fluid that is to be fed into the cleaning chamber can be taken from a storage vessel which is not illustrated in the drawing. In addition or as an alternative thereto, a fluid accommodated in the cleaning chamber can be removed from and then returned to the cleaning chamber by means of the slotted nozzle. For this purpose, use can be made of a pump which works as a recirculating pump for draining the fluid from the cleaning chamber. Preferably, the recirculating pump is also used for returning the drained-off fluid to the cleaning chamber as a fresh charge. It is advantageous for the fluid that has been drained-off from the cleaning chamber to be filtered by means of a filter device before it is fed back afresh into the cleaning chamber.

The common fluid line 156 merges into a connection pipe 170 which passes through the second end wall 110 and projects into the container 102. For the purposes of sealing the fixed connection pipe 170 and the movable housing 134, there is provided a rotary joint 172 which can also be referred to as a "pipe joint".

The connection pipe 170 forms a central point of access to the fluid space 138. This access point can be used for filling the cleaning chamber 104 with a liquid, for discharging a spray of liquid from the slotted nozzle 116 into the cleaning chamber, for blowing a gas out of the slotted nozzle 116 into the cleaning chamber and for evacuating the cleaning chamber.

Figure 3:
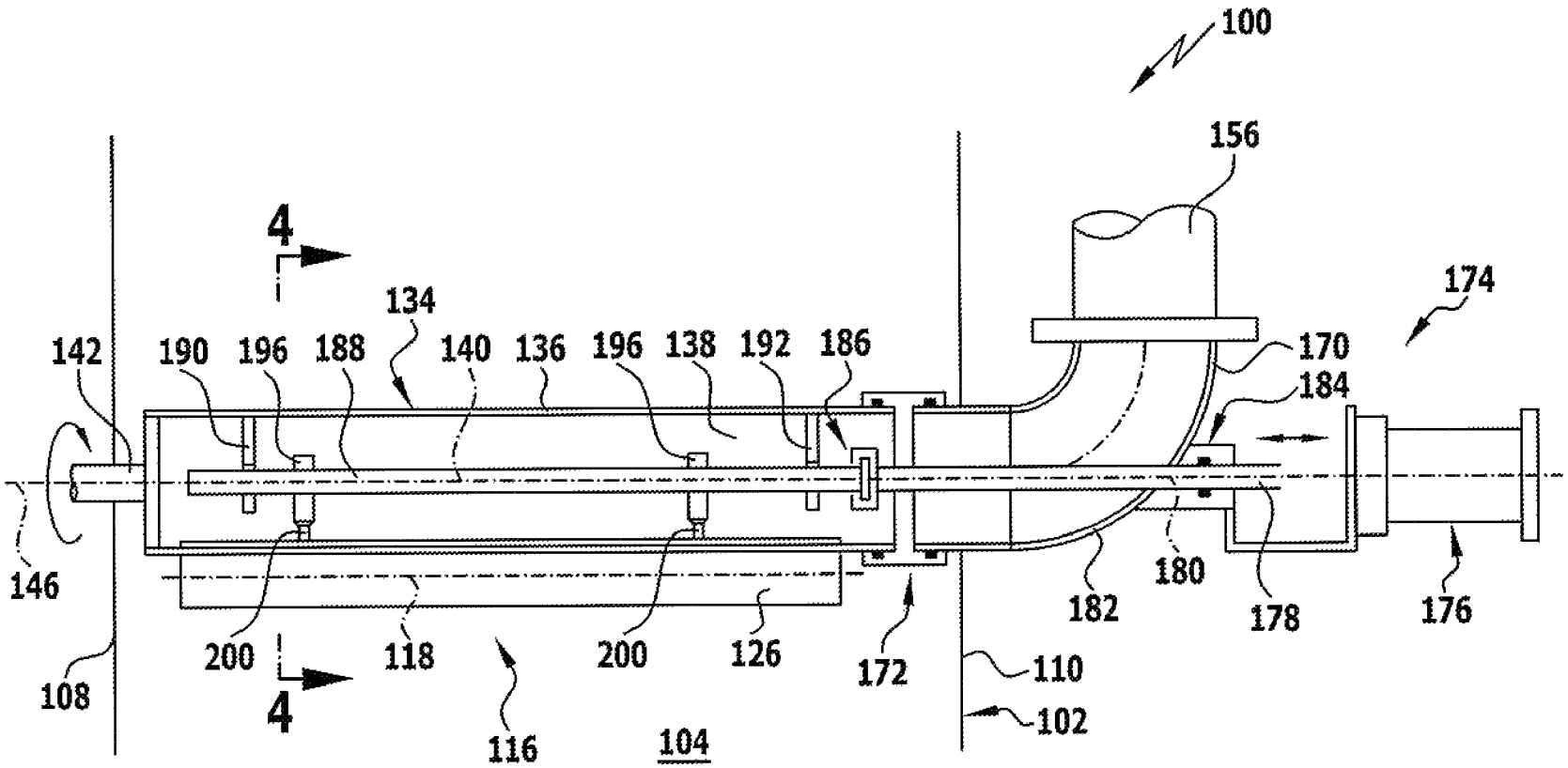
FIG. 3 a schematic section through the slotted nozzle along the line 3-3 in FIG. 2.

Furthermore, the cleaning device 100 comprises a slot-width adjusting device 174 for adjusting the width of the slot 128 of the slotted nozzle 116 (FIG. 3).

For example, the slot-width adjusting device 174 comprises a driving device 176 in the form of a motor for producing the movement of a drive element 178 along an adjustment axis 180.

The drive element 178 passes through a pipe wall 182 of the connection pipe 170 and is sealed relative to the pipe wall 182 by means of a seal device 184.

The drive element 178 ends at a rotary coupling 186 at the end thereof remote from the driving device 176. The rotary coupling 186 is arranged within the fluid space 138. The drive element 178 and an adjusting element 188 are rotationally decoupled from one another by means of the rotary coupling 186. This means that a linear movement of the drive element 178 along the adjustment axis 180 is transferable to the adjusting element 188 by means of the rotary coupling 186 but that a rotary movement of the adjusting element 188 about the axis of rotation 146 will not be transferred to the drive element 178.

The adjusting element 188 is in the form of a bar which extends along the adjustment axis 180. The adjustment axis 180 and the axis of rotation 146 are collinear.

The adjusting element 188 is mounted such that it is rotatable about the axis of rotation 146 by means of a first bearing 190 and by means of a second bearing 192. The bearings 190, 192 are fixed to the housing 134.

Figure 4:
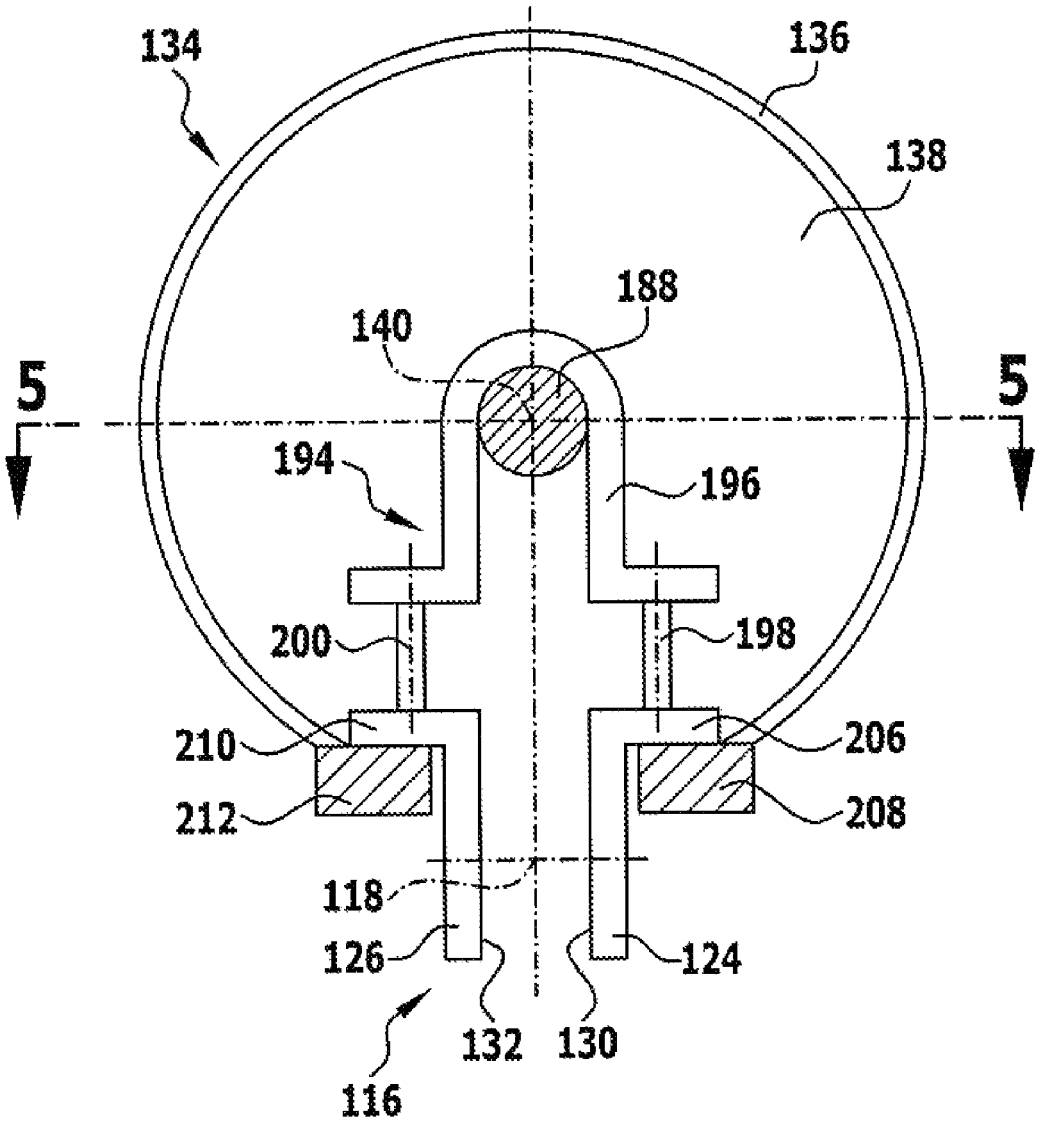
FIG. 4 a section through the slotted nozzle along the line 4-4 in FIG. 3.

Furthermore, the slot-width adjusting device 174 comprises a transmission device 194 (FIGS. 4 and 5) by means of which a linear movement of the adjusting element 188 along the adjustment axis 180 can be translated into a movement of the slot delimiting elements 124, 126 in a direction transverse to the slot axis 118. The transmission device 194 comprises two mutually spaced hoops 196 which are connected in mutually non-rotatable manner to the adjusting element 188. The hoops 196 are each connected in mutually non-rotatable manner to two pins 198, 200. The pins 198, 200 extend in a direction perpendicular to the adjustment axis 180. Each of the first pins 198 engages in a respective first guideway 202 of the first slot delimiting element 124. Each of the second pins 200 engages in a respective second guideway 204 of the second slot delimiting element 126.

Each of the first guideways 202 is formed in a first bearing section 206 of the first slot delimiting element 124 which is part of the first slot delimiting element 124. The first bearing section 206 extends substantially perpendicularly to the first slot delimiting surface 130 and is supported on a first guide element 208 which is fixed to the housing wall 136.

Each of the second guideways 204 is formed in a second bearing section 210 which is part of the second slot delimiting element 126. The second bearing section 210 extends substantially perpendicularly to the second slot delimiting surface 132 and is supported on a second guide element 212 which is fixed to the housing wall 136.

The guideways 202, 204 are inclined to the slot axis 118.

The slotted nozzle 116 is part of a fluid transfer device 214. The fluid transfer device 214 enables a fluid to be fed through the slotted nozzle 116 into the cleaning chamber 104 and/or a fluid to be fed out from the cleaning chamber 104.

The previously described cleaning device 100 functions as follows:

In preparation for the cleaning of a workpiece 114, it is arranged within the cleaning chamber 104. A holding device 216 (FIG. 2) can be used for holding the workpiece 114 in place. The workpiece 114 can be fixed relative to the accommodating chamber 104 and/or relative to a workpiece moving device, which is not illustrated in the drawing for reasons of clarity, by means of the holding device 216. Such a workpiece moving device enables the holding device 216 together with the workpiece 114 to be rotated about a rotational axis 218. It is preferable for the rotational axis 218 to extend in parallel with the slot axis 118.

For the purposes of assisting the cleansing of the workpiece 114, the cleaning chamber 104 can be filled with a liquid, with water for example, into which the workpiece 114 is dipped. The filling of the cleaning chamber 104 can, for example, be effected by using the first pump 158 and the first fluid line 150 of the fluid line system 148 and then discharging a preferably filtered liquid from the slotted nozzle 116 into the cleaning chamber by making use of the fluid transfer device 214.

The cleaning chamber 104 can be filled with liquid within a short interval of time with the help of the slotted nozzle 116. The cleaning chamber 104 can also be emptied in the same time interval (for example, by means of a cleaning chamber outlet which, although not illustrated in the drawing, is arranged at the lower end of the container 102 taken with reference to the direction of gravity for example) so that a bath in the cleaning chamber can be recirculated at high frequency. Overall, this results in very low non-productive periods in addition the actual cleaning times.

For the purposes of cleaning the workpiece 114, a fluid can be fed-out in the direction of the workpiece 114 by means of the slotted nozzle 116. This fluid has a mean direction 220 for the transfer of the fluid. The mean direction 220 for the fluid transfer process is adjustable by rotating the slot axis 116 about the axis of rotation 146 with the help of the slotted nozzle moving device 144. Preferably, the mean direction 220 for the transfer of the fluid is set in such a manner that it includes an angle 224 of at least approximately 30° to at most approximately 70° with that surface 222 of the workpiece which is to be cleaned.

For example, the workpiece 114 can be cleaned by means of a first fluid in the form of a preferably filtered liquid. If so desired, the first fluid can be identical to the fluid that was previously fed-in for the purposes of flooding the cleaning chamber. The first fluid is supplied to the fluid space 138 and thus to the slotted nozzle 116 by means of the first fluid line 150. The first valve 160 is opened for this purpose. The second valve 164 and the third valve 168 are closed. Then, pressure is applied to the first fluid with the help of the first pump 158, and the fluid is conveyed to the fluid space 138. From there, the fluid enters the cleaning chamber 104 through the slot formed between the slot delimiting elements 124 and 126, the fluid being distributed along the slot axis 118. The slotted nozzle 116 is swung about the axis of rotation 146 by moving the housing 134 about the axis of rotation 146. It is preferable for the housing 134 to be freely rotatable about the axis of rotation 146 so that the mean direction 220 for the transfer of the fluid is adjustable in all desired angular directions.

The discharge of the fluid can take place at a very high rate of fluid flow of 40 litres per second for example compared with conventional systems. In the case of a slot length of 60 cm as measured in parallel with the slot axis 118 and a slot-width 128 of 0.4 cm, there is a resultant discharge speed of 16.7 m/s. In a flood washing process wherein the workpiece 114 is immersed in a liquid, a current flowing at a rate of 70 mm/s towards an outlet of the cleaning chamber 104 can be achieved at such a discharge speed. Particles needing to be removed from the workpiece 114 can thereby be loosened and/or carried away in an effective manner.

The slotted nozzle 116 and/or the workpiece 114 can be moved during the discharge of the fluid from the slotted nozzle 116. It is preferable for the movements of the slotted nozzle 116 and the workpiece 114 to be coupled to one another so as to enable particularly thorough and effective cleansing of the workpiece 114.

It is possible to clean and/or dry the workpiece 114 not just with a first fluid, but so too with a second fluid. The second fluid is preferably gaseous and in particular, is in the form of compressed air. The second fluid can be supplied to the fluid space 138 with the help of the second pump 162 when the second valve 164 is in its opened state. Hereby, the first valve 160 and the third valve 168 are closed. In this way, the second fluid can be discharged through the slotted nozzle 116 in the direction of the workpiece 114.

A further way in which the cleaning device 100 can be operated envisages that a fluid can be exhausted from the cleaning chamber 104. For example, the third pump 166 can work as a vacuum pump so that, after the opening of the third valve 168 and closure of the first valve 160 and the second valve 164, fluid contained in the cleaning chamber 104 can be sucked out through the slotted nozzle 116 and the fluid space 138. Particularly effective cleaning of the workpiece 114 can thereby be effected.

The cleaning device 100 can also be used in order to clean the chamber wall 106. For this purpose, the cleaning chamber 104 is preferably emptied with the help of the pump 166 and any workpiece 114 that may be accommodated in the cleaning chamber 104 is removed. Subsequently, a fluid can be applied to the inner sides of the chamber wall 106 by feeding out a fluid and in particular a liquid, by means of the slotted nozzle 116. Hereby, it is preferred that the slotted nozzle moving device 144 be moved through at least 360° or more about the axis of rotation 146. Effective and simple cleansing of the entire chamber wall 106 is thereby made possible.

In preparation for the cleaning of a workpiece 114 and/or a chamber wall 106 or during a cleaning process itself, one can adjust the width of the slot 128 which is determined by the spacing of the slot-width delimiting surfaces 130 and 132. For this purpose, the driving device 176 is controlled in such a manner that the drive element 178 effects a stroke movement along the adjustment axis 180. This movement is transferred to the adjusting element 188 by means of the rotary coupling 186. The movement of the adjusting element 188 along the adjustment axis 180 is transferred with the help of the hoops 196 to the pins 198 and 200. The pins 198, 200 which engage in the guideways 202, 204 of the slot delimiting elements 124, 126 are moved in a direction parallel to the adjustment axis 180 by a movement of the adjusting element 188 along the adjustment axis 180.

Figure 5:
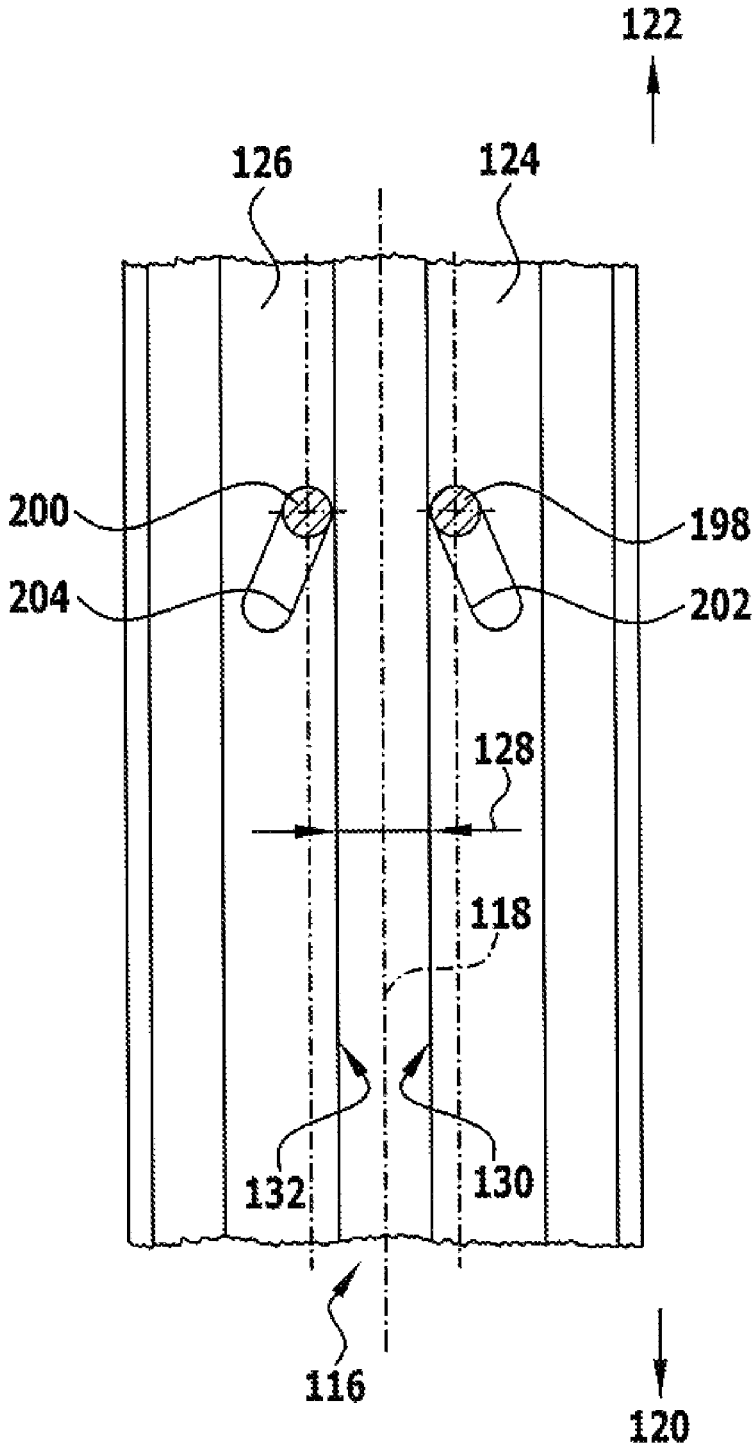
FIG. 5 a section through the slotted nozzle along the line 5-5 in FIG. 4.

The slotted nozzle 116 is illustrated in FIG. 5 where the slot-width 128 is at its maximum. A movement of the adjusting element 188 in the direction of the first end 120 of the slotted nozzle causes the pins 198, 200 to be displaced in the direction of the first end 120 of the slotted nozzle. The slot delimiting elements 124, 126 associated with the respective pins 198, 200 are thereby moved inwardly in the direction of the slot axis 118. In consequence, the slot-width 128 is made smaller. Enlargement of the slot-width 128 is effected in a corresponding manner by a movement of the adjusting element 188 in the direction of the second end 122 of the slotted nozzle.

Preferably, the slot-width 128 is adjusted in dependence on the density of the fluid flowing through the slotted nozzle 116. A smaller slot-width 128 is preferred for fluids of higher density such as liquids for example; a larger slot-width 128 is preferred for fluids of lesser density such as compressed air for example.

Figure 6:
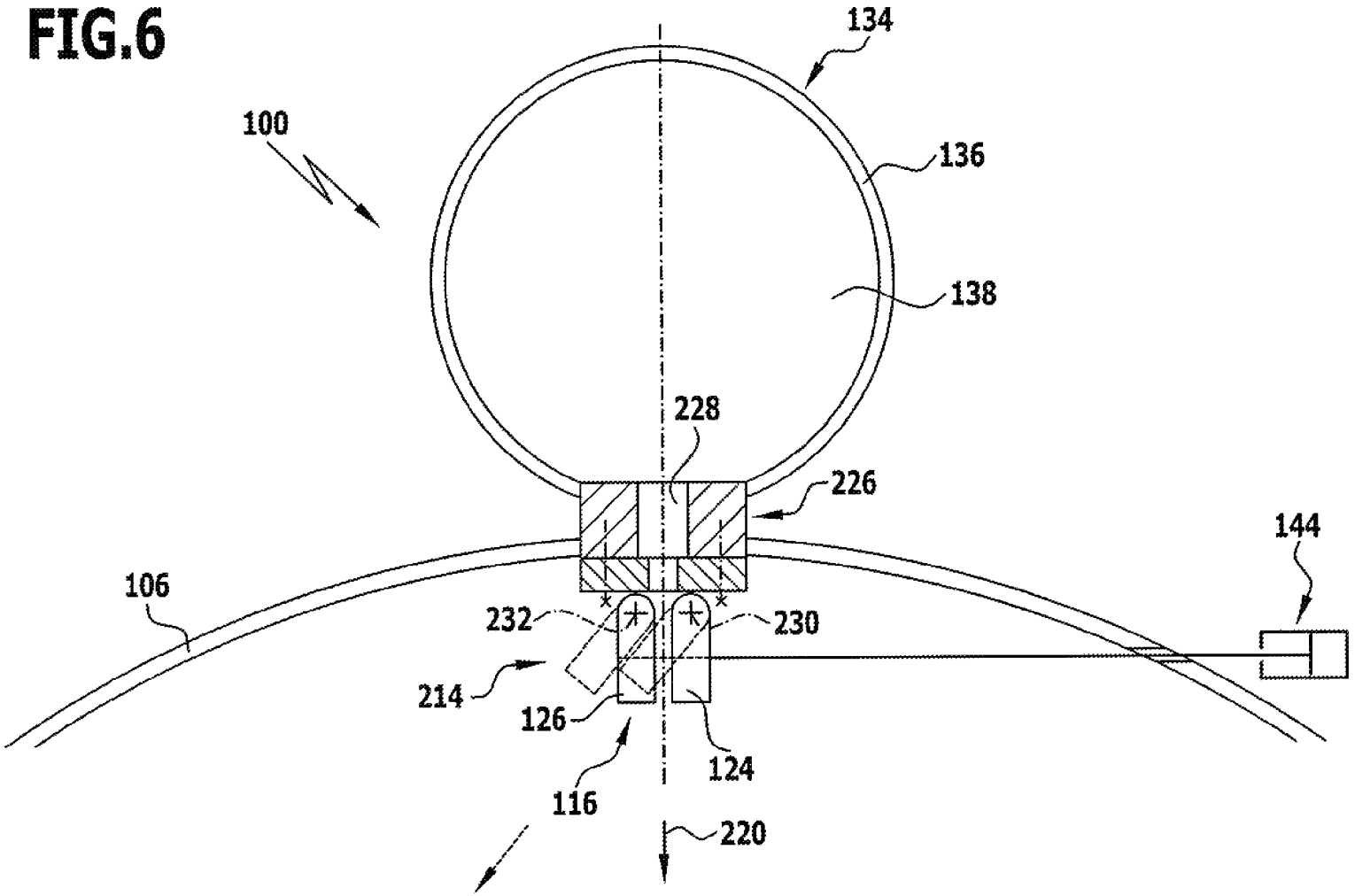
FIG. 6 a detail of a schematic section through a second embodiment of a cleaning device.

A second embodiment of a cleaning device 100 for the cleaning of a workpiece 114 which is illustrated in FIG. 6 differs from the first embodiment illustrated in FIG. 1 in that the second embodiment does not incorporate a slot-width adjusting device and in that it has a housing 134 which is fixed to a chamber wall 106 of a cleaning chamber 104. For the purposes of connecting the housing 134 to the chamber wall 106, there is provided a connecting device 226 which is welded to both the chamber wall 106 and the housing wall 136.

The connecting device 226 has a fluid channel 228 which provides a fluidic connection between the fluid space 138 of the housing 134 and a slotted nozzle 116 of a fluid transfer device 214. The slotted nozzle 116 is in turn connected in fluid conveying manner to the cleaning chamber 104.

The slotted nozzle 116 has two slot delimiting elements 124, 126 which are pivotal about a respective pivotal axis 230, 232. The pivotal axes 230, 232 are parallel to one another. A desired mean direction 220 for the transfer of fluid through the slotted nozzle 116 can be set by pivoting the slot delimiting elements 124, 126 about the pivotal axes 230, 232 by means of a slotted nozzle moving device 144.

In all other respects, the second embodiment of the cleaning device 100 which is illustrated in FIG. 6 corresponds as regards the construction and functioning thereof to the first embodiment illustrated in FIG. 1 so that to this extent reference is made to the preceding description.

The invention claimed is:

1. A cleaning device comprising a cleaning chamber for accommodating a workpiece requiring cleaning and a fluid transfer device for transferring at least one fluid into the cleaning chamber and/or out of the cleaning chamber, wherein the fluid transfer device comprises at least one nozzle in the form of a slotted nozzle which extends along a slot axis and the at least one fluid is arranged to be fed into the cleaning chamber or fed out of the cleaning chamber by means of said slotted nozzle in a direction transverse to the slot axis, wherein the cleaning device comprises a slotted nozzle moving device for moving at least a part of the slotted nozzle, wherein the cleaning chamber can be filled with a liquid bath into which a slotted nozzle opening of the slotted nozzle is arranged to be dipped, said cleaning device further comprising a slot-width adjusting device for adjusting the slot-width of the slotted nozzle.

2. A cleaning device in accordance with claim 1, wherein the fluid transfer device comprises a fluid feed-in device for feeding at least one fluid into the cleaning chamber.

3. A cleaning device in accordance with claim 1, wherein the fluid transfer device comprises a fluid feed-out device for feeding at least one fluid out of the cleaning chamber.

4. A cleaning device in accordance with claim 1, wherein the slotted nozzle is pivotal or rotatable by means of the slotted nozzle moving device.

5. A cleaning device in accordance with claim 1, wherein the slot-width adjusting device comprises at least one adjusting element which is movable along an adjustment axis.

6. A cleaning device in accordance with claim 5, wherein the adjustment axis is substantially parallel to the slot axis.

7. A cleaning device in accordance with claim 5, wherein the at least one adjusting element is pivotal or rotatable about the adjustment axis.

8. A cleaning device in accordance with claim 5, wherein the at least one adjusting element is pivotal or rotatable independently of linear movement along the adjustment axis of the at least one adjusting element.

9. A cleaning device in accordance with claim 5, wherein the slot-width adjusting device and the slotted nozzle moving device are operable independently of one another.

10. A cleaning device in accordance with claim 1, wherein the cleaning chamber has at least one chamber wall and in that a direction in which the fluid is fed-in through the slotted nozzle is adjustable in such a manner that at least one section of at least one chamber wall of the cleaning chamber can be cleaned by means of the fluid being fed-in.

11. A cleaning device in accordance with claim 1, further comprising a fluid line system which is connected in fluid conveying manner to the fluid transfer device for the purposes of supplying or removing a fluid and comprises a plurality of fluid lines for mutually differing fluids.

12. A cleaning device in accordance with claim 1, further comprising a workpiece moving device for moving a workpiece that is accommodated in the cleaning chamber relative to the slotted nozzle.

13. A cleaning device in accordance with claim 1, wherein at least a section of a workpiece requiring cleaning is arranged to be dipped into the liquid bath.

14. A method for the cleaning of a workpiece in which a workpiece is arranged in a cleaning chamber and at least one fluid is fed into the cleaning chamber or fed out from the cleaning chamber by a fluid transfer device which comprises a nozzle in the form of a slotted nozzle which extends along a slot axis and wherein the direction of feed is transverse to the slot axis, wherein at least a part of the slotted nozzle is moved relative to the cleaning chamber by a slotted nozzle moving device, wherein the cleaning chamber is filled with a liquid bath into which a slotted nozzle opening of the slotted nozzle is dipped, said fluid transfer device further comprising a slot-width adjusting device for adjusting the slot-width of the slotted nozzle.

* * * * *